United States Patent [19]

Dillon et al.

[11] Patent Number: 4,955,291

[45] Date of Patent: Sep. 11, 1990

[54] CONVEYOR WITH SELF PROPELLED VEHICLES EACH HAVING AN ON BOARD CONTROL

[75] Inventors: David M. Dillon, Grand Ledge; Michael R. Boyer, James F. Foster, both of Lansing, all of Mich.

[73] Assignee: Roberts Sinto, Lansing, Mich.

[21] Appl. No.: 219,014

[22] Filed: Jul. 14, 1988

[51] Int. Cl.[5] ..... B61L 23/24

[52] U.S. Cl. ..... 104/299; 105/61; 246/167 D

[58] Field of Search ..... 105/49, 50, 61; 104/287, 288, 2295, 299–302, 88; 246/167 D, 182 R, 186, 187 R, 187 A, 187 B; 180/167–169; 318/599, 294

[56] References Cited

U.S. PATENT DOCUMENTS

| | | | |
|---|---|---|---|
| 3,365,572 | 1/1968 | Strauss | 246/167 D |
| 3,594,572 | 7/1971 | Horeczky | 246/182 R X |
| 3,899,041 | 8/1975 | Mager | 105/50 X |
| 4,361,202 | 11/1982 | Minovitch | 246/167 D |
| 4,454,454 | 6/1984 | Valentine | 318/257 X |
| 4,523,134 | 6/1985 | Kinoshita et al. | 318/599 X |
| 4,554,873 | 11/1985 | Rex | 104/88 |
| 4,649,326 | 3/1987 | Mansmann et al. | 318/294 X |
| 4,673,851 | 6/1987 | Disser | 318/599 X |
| 4,763,052 | 8/1988 | Lundin et al. | 318/599 X |

*Primary Examiner*—Margaret A. Focarino
*Assistant Examiner*—Joseph D. Pape
*Attorney, Agent, or Firm*—Raymond J. Eifler; John R. Benefiel

[57] ABSTRACT

A conveyor system (10) is disclosed comprised of a plurality of vehicles (12), propelled about a guide track (14) by a D.C. motor (54) and battery (52), featuring an on-board control (40) in which signals from fore and aft and side mounted photosensors (32,34,36,38) are processed by a microprocessor (42), to generate control signals for pulse width modulated control of the power to the D.C. motor (54). The control signals are applied to a motor driver circuit (50), including an H-bridge of MOSFET switching components (Q1,Q2,Q3,Q4). A ramping or progressive variation of the power applied to the motor (54) is carried out to provide gradual acceleration or deceleration, and the fore and aft photodetectors (32,34) are triggered by the approach of another vehicle (12) at a substantial distance, to accommodate the distance required for gradual deceleration when the vehicles (12) are being queued at points along the track (14).

7 Claims, 9 Drawing Sheets

CONVEYOR WITH SELF PROPELLED VEHICLES EACH HAVING AN ON BOARD CONTROL

This invention concerns conveyors of the type comprising self propelled vehicles driven about a track to carry workpieces between stations arranged along the track.

There has heretofore been developed conveyor systems in which a series of self propelled vehicles are driven in a forward or reverse direction along a track, and stopped in one or more stations along the track by discontinuing the propulsion of the vehicle.

Certain of the present inventors have heretofore developed a queueing control for such vehicles using photosensors located fore and aft on the vehicle to detect the presence of another vehicle or a movable barrier ahead on the track in the direction of travel, and stopping propulsion of the vehicle as long as the next ahead vehicle or barrier remains as an obstacle. Such system also included side mounted photosensors triggered by photoemitters to also control the vehicle propulsion. Such side mounted photosensors were paired in order to switch to a slow speed prior to stopping completely for better accuracy in positioning the vehicle.

This system featured self contained on-board control for each vehicle to control a drive motor in response to the photo detector signals, and hence the vehicle controls involves a significant expense, particularly for a system having a number of such vehicles.

That control was heretofore comprised of a discrete component logic circuit, involving relays, switches, etc., relatively costly and incapable of more sophisticated control functions.

The stopping and starting of the vehicle, particularly when queuing, causes lurching and can result in shifting of the work pieces on the vehicle. Also, the on-off propulsion control makes it more difficult to achieve adequate positional accuracy for some situations.

While the two stage stop involving a slow down phase by the use of pairs of photoemitters avoids these problems, this approach necessitates a more complex system involving more numerous photoemitters.

Also, this approach does not solve the problem in the context of the queueing of the vehicles by detecting the next ahead vehicle and stopping the vehicle by completely discontinuing drive.

SUMMARY OF THE INVENTION

The present invention comprises a conveyor formed by a series of self propelled vehicles driven about a track each having a self-contained, onboard control in which a programmed microprocessor receiving the photosensor signals is combined with a motor driver circuit including a four-quadrant driver circuit using MOSFET solid state switching devices arranged in an H-bridge to enable a pulse width modulated control, capable of providing programmable control features.

The fore and aft located photosensors are set to generate a signal when the next ahead vehicle (or a barrier) is still a substantial distance from the controlled vehicle, on the order of several inches to a foot, and a ramped, gradual deceleration of the vehicle is carried out by a progressive reduction in the power supplied to the D.C. drive motor by the microprocessor program, bringing the vehicle to a gradual stop over the intervening distance.

The on-board control of the present invention enables a sophisticated control at relatively low cost, involving a minimum of components.

The control enables both ramped deceleration and acceleration when stopping or starting or when changing speeds, so that lurching of the vehicle is avoided.

DETAILED DESCRIPTION

Figure 1:
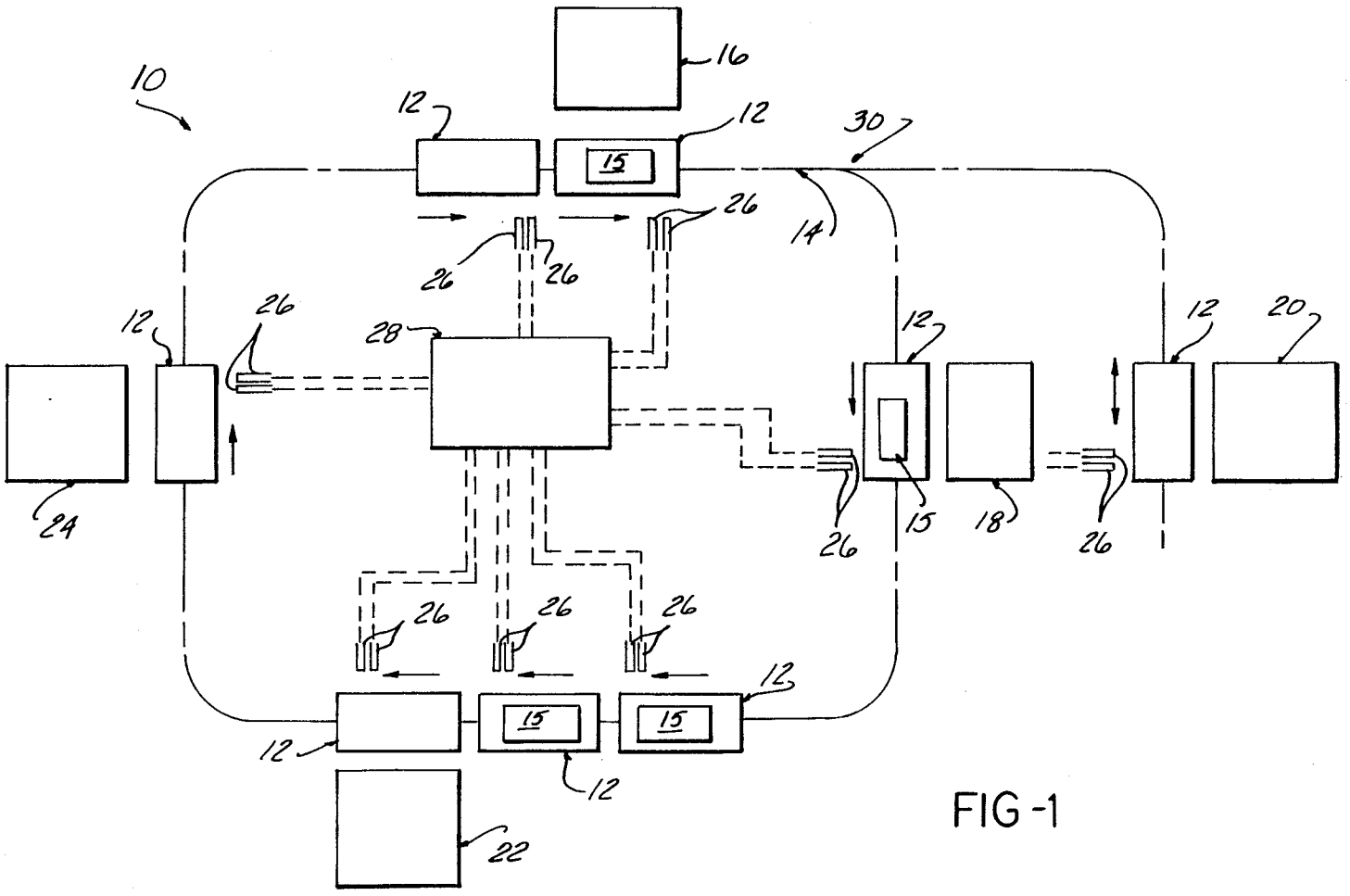
FIG. 1 is a diagrammatic plan view of a typical conveyor system utilizing self propelled vehicles, each having an on-board control according to the present invention.

FIG. 1 illustrates a conveyor system 10 comprised of a plurality of self-propelled vehicles 12 driven about a track 14 to carry workpieces 15 between a plurality of stations 16–24 whereat various operations are conducted, such as load, unload, battery charge, etc. Each vehicle 12 is battery powered to be driven by a drive motor, and such propulsion is controlled to bring each vehicle 12 to rest in each station 16–24. Thus signals must be generated to cause such stopping within the station 16–24, and also to allow queueing of vehicles 12 when more than one vehicle is ready to enter a station 16–24.

In copending U.S. patent application Ser. No. 922,497 filed on Oct. 23, 1986, now abandoned, there is disclosed in detail the construction of such a vehicle, in which photo detectors are mounted on the side and fore and aft of the vehicle 12, reacting either to a photoemitter or the presence of a next ahead vehicle or barrier to cause discontinuing of power to the drive motor and consequent stoppage of the vehicle.

Thus a plurality of photoemitters 26 are arranged about the track 14 under the control of system managing control means, i.e. industrial computer 28 which generates control signals to interreact with the on-board control as to start, stop, vary the speed or direction, etc, of each vehicle 12.

A mechanical track junction 30 may be incorporated to route vehicles 12 to alternative location, which junction and associated two position control pins carried by the vehicle is described in detail in copending U.S. patent application Ser. No. 171,087, filed on Mar. 21, 1988.

The on-board control according to the present invention provides more sophistication than a simple on-off of motor power or two stage reduction of speed by multiple photoemitters.

Figure 2:
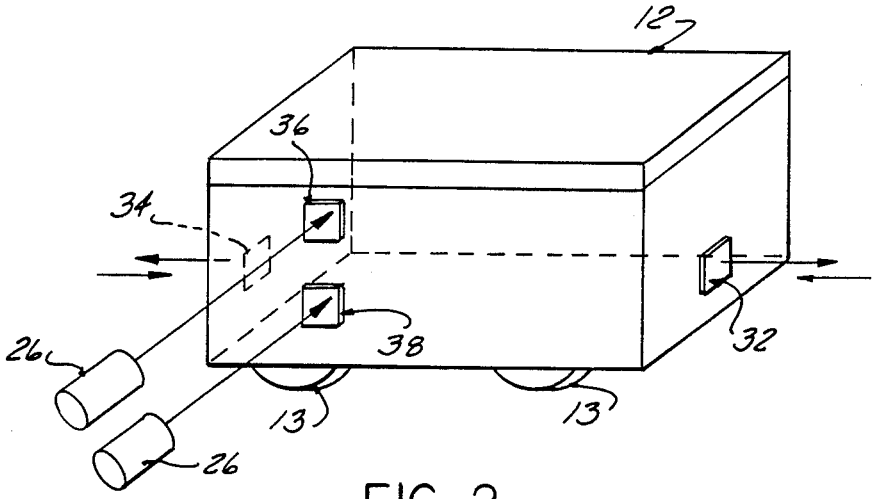
FIG. 2 is a perspective view of an individual vehicle illustrating the placement of photosensors.

FIG. 2 illustrates a vehicle 12 supported on wheels 13 in which fore and aft mounted photodetectors 32, 34 are mounted directed forwardly and rearwardly of the vehicle, and also a pair of side mounted photodetectors 36, 38 located to receive control signals from photoemitters 26.

Figure 3:
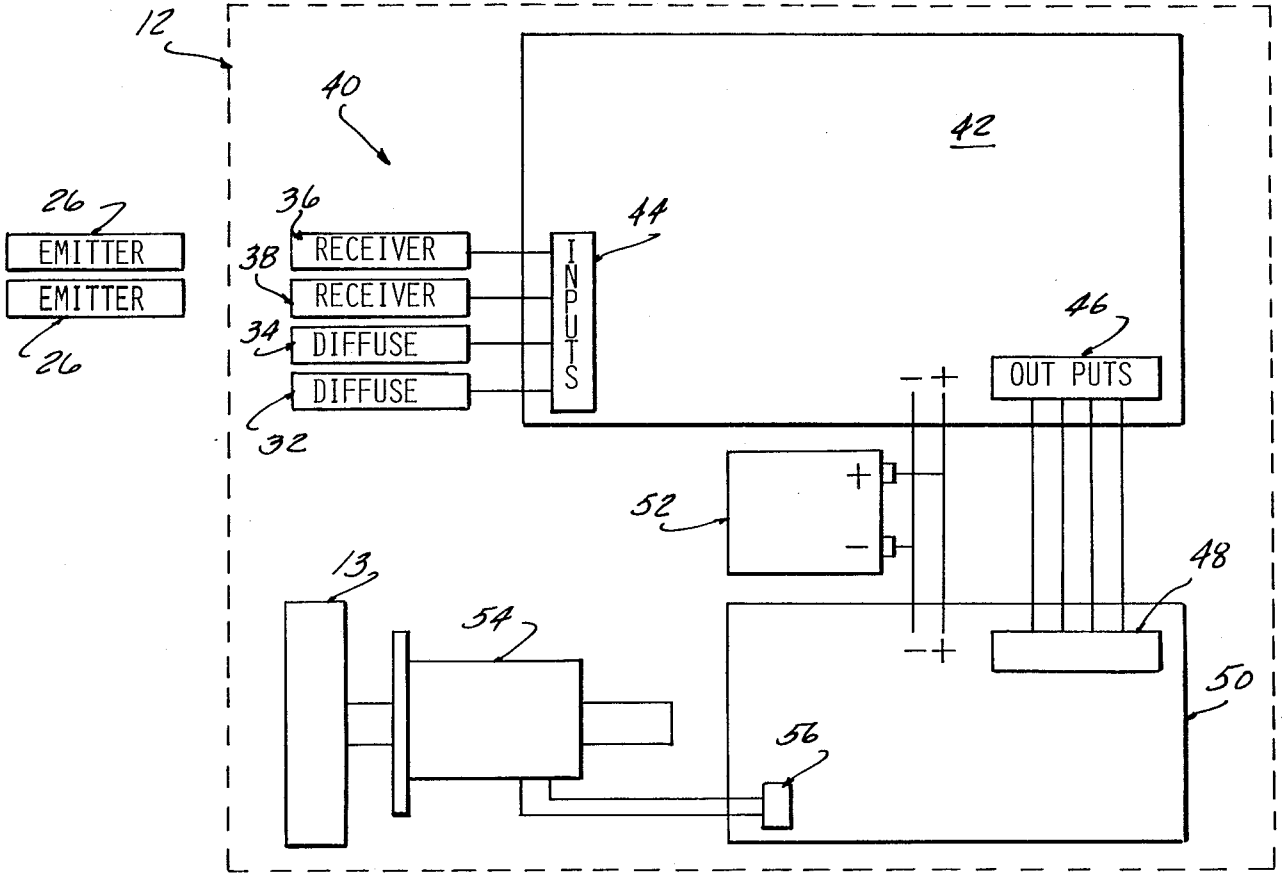
FIG. 3 is a diagrammatic view of the on-board control of each vehicle.

FIG. 3 illustrates in diagrammatic form the basic components of the on-board control 40, including a central processor with Input/Output (CPU/IO) board 42, receiving inputs at terminal 44 from the fore and aft diffuse reflective photodetectors 32, 34 and the side mounted photodetectors 36, 38 excited by photo emitters 26. Motor control outputs are transmitted at output terminal 46 to an input terminal 48 on a motor driver board 50. The on board battery 52 powers the CPU/IO board 42 and the motor driver board 50, as well as supplying sufficient power for the D.C. drive motor 54 driven by power outputs transmitted from output terminal 56 of the motor driver board 50.

The D.C. motor 54 is controlled to normally maintain a constant preselected speed, which can be selectively varied as per the needs of the application, and deceleration and acceleration is "ramped", i.e. gradually achieved over a preset time interval. The power to the D.C. motor 54 is pulse width modulated by the control 40 to achieve these control objectives.

Figure 4:
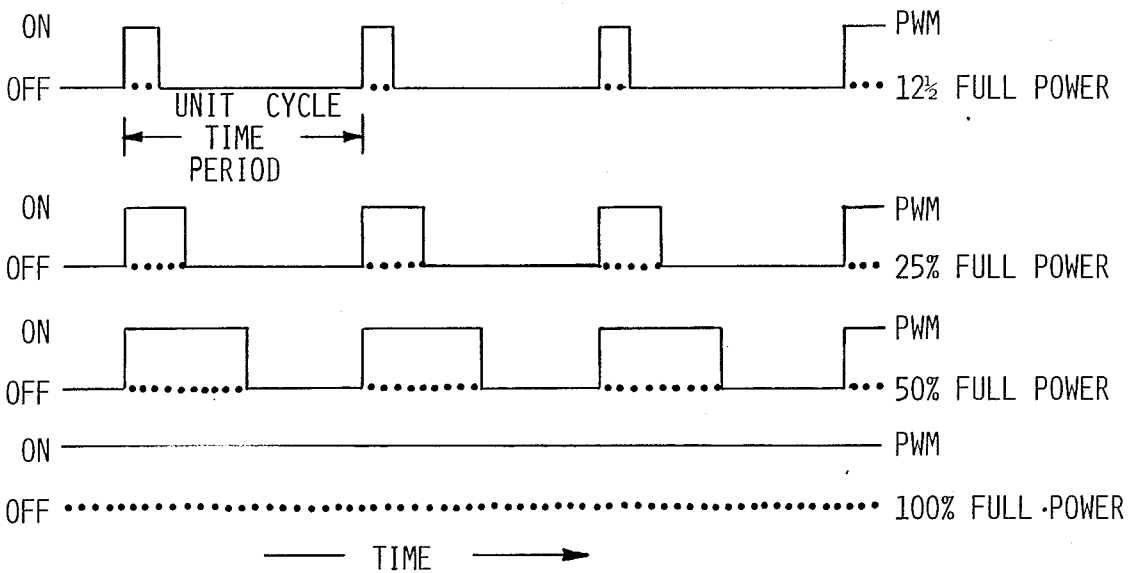
FIG. 4 is a plot illustrating the pulse width modulation motor control principle.

FIG. 4 illustrates this principle, in which the source voltage is applied to the motor windings for a selectively controlled fraction of each of a unit time cycle. That is, if the voltage is on for $\frac{1}{8}$ of the cycle, the D.C. motor 54 is powered at $12\frac{1}{2}$% of full power, if for $\frac{1}{4}$ of the cycle, at 25% of full power and so on. This provides an energy efficient throttling of the power.

Figure 5:
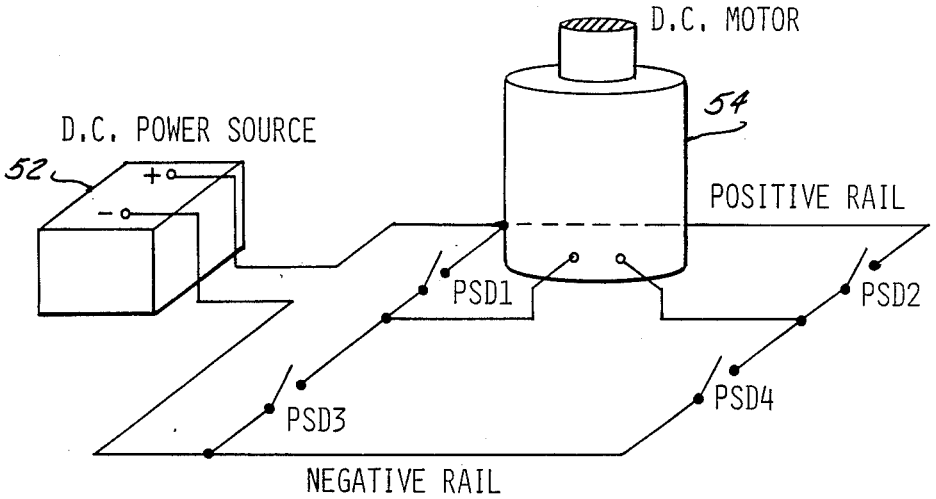
FIG. 5 is a diagrammatic perspective of an H-bridge motor driver circuit.

FIG. 5 illustrates the basic "four quadrant" H-bridge driver circuit utilized in the present control. "Four quadrant" control refers to four possible conditions, i.e., firstly, motor rotating in a forward direction and continued powering in that direction; secondly, the same for reverse motor; thirdly, the motor rotating forwardly, and reverse rotation required; and, fourthly, the motor rotating reversely, and forward rotation desired.

If switches D1 and D4 are closed and switches D2 and D3 are open, forward rotation power is applied, while if D3 and D2 are closed and D1 and D4 are open, reverse rotation power is applied.

According to the present invention, N type Metal Oxide Field Effect Transistors (MOSFETS) are utilized as the switching devices. These devices have a very low resistance when conducting and very high impedance when off, and are able to accommodate 20 amps of current, so as to enable switching of the power to the motor 54, while at the same time requiring very little power to control. Thus a suitably programmed microprocessor can be employed.

Figure 6:
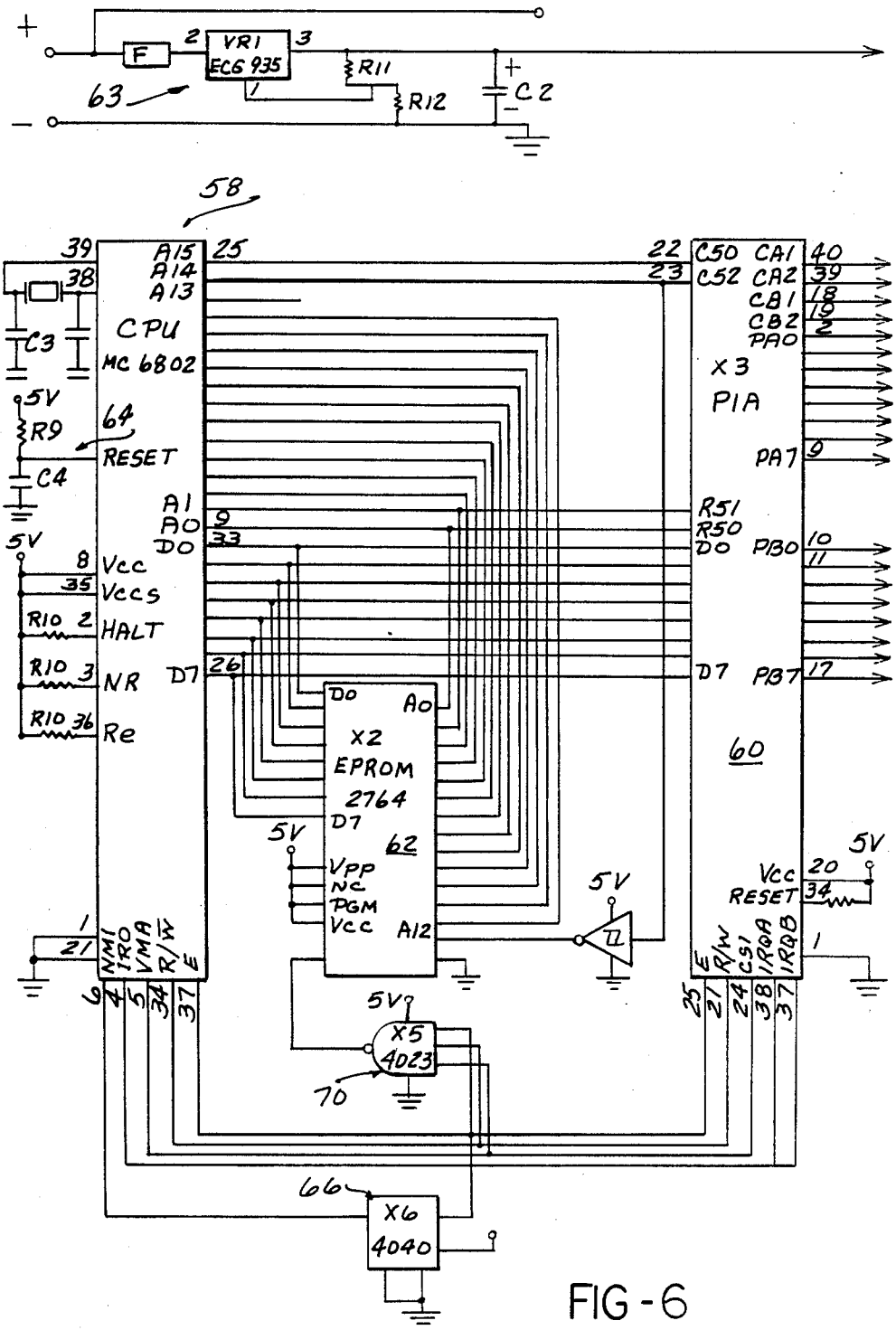
FIGS. 6 and 6A are schematic diagrams of the microprocessor chip and associated EPROM and PIA included in the control board according to the present invention.
Figure 6A:
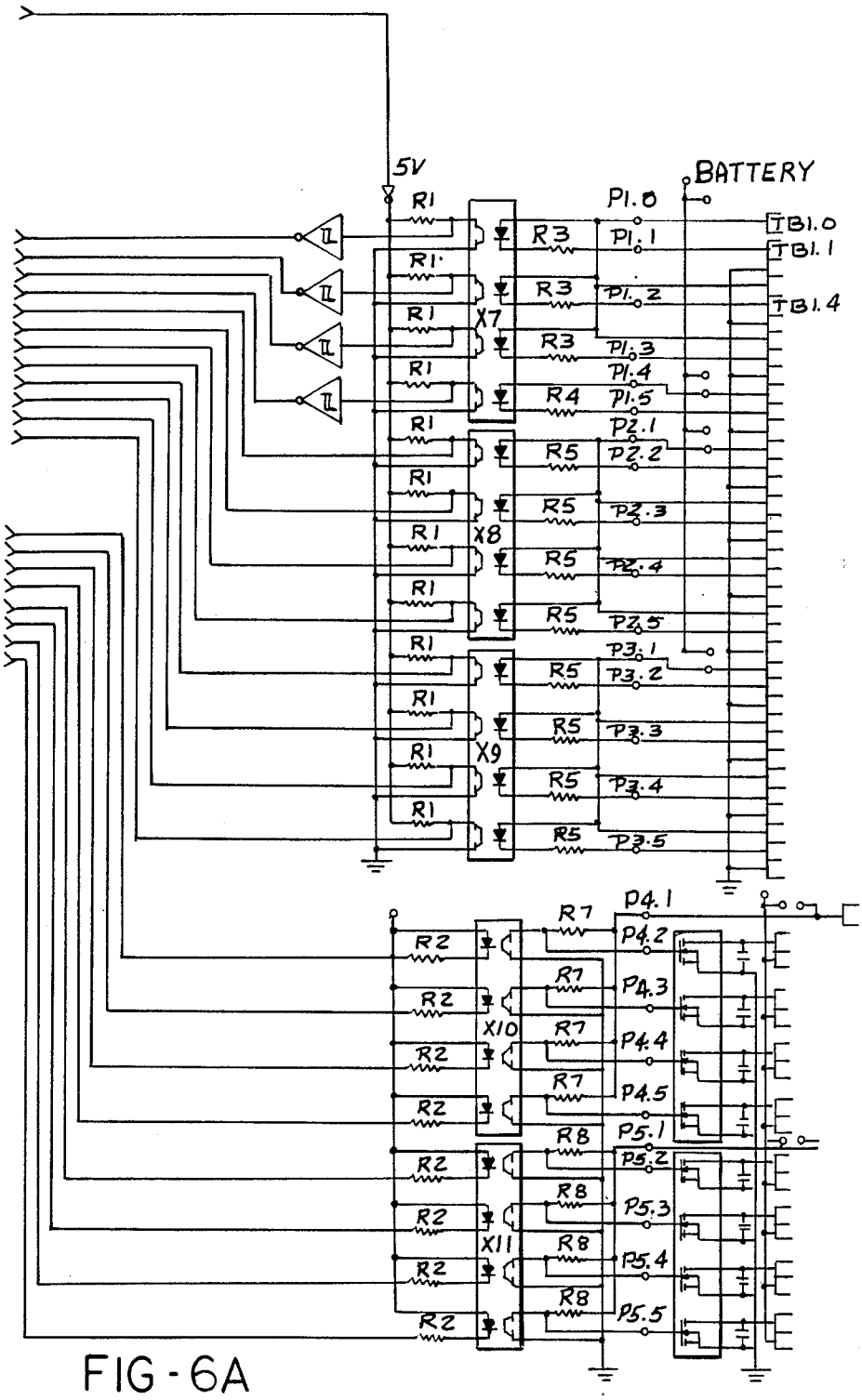

FIGS. 6 and 6A depicts the circuitry of the CPU board 42, consisting of a MOTOROLA 6802 central processing unit (CPU or microprocessor) 58, a MOTOROLA 6821 Parallel Interface Adaptor (PIA) 60, an 8 Kilo-byte Ultra Violet Erasable Programmable Read Only Memory (UV-EPROM) 62, 4 optically isolated—schmidt triggered interrupt inputs, P1.0, P1.2, P1.3, P1.5, 8 optically isolated general purpose inputs P2.2–P2.5, P3.2–P3.5, and 8 optically isolated—Field Effect Transistor (FET) buffered outputs P4.2–P4.5, P5.2–P5.5. There is 128 bytes of Random Access Memory (RAM) contained within the 6802 CPU. Both the interrupt inputs and ther general purpose inputs require nominally 15 milli-amps of D.C. current to register a sinking nominally 50 milli-amps of D.C. current. These inputs enable various features to be optionally included, such as a speed control feed back from the D.C. motor 54.

A voltage regulator circuit 63 is utilized to provide 5v power to the CPU/IO board components. An external clock pulse source for computing operations, comprising a crystal oscillator 64 generating a 4.0 MHZ signal is connected to P38, P39. A delay start up reset circuit 64 is connected to P40, while P8, P35, P2, P3 and P36 are connected to the 5v source, while P1, P21 are grounded per the manufacturer's recommendation.

A divide circuit 66 takes the internally divided 4.0 MHZ clock signal (1 MHZ) from P37 and divides by 1024 to generate a basic cycle clock of approximately 1000 KHZ entered on P6, a non maskable interrupt.

Various housekeeping connections are made, as will be understood by those skilled in the art, such as NAND gate 70 detecting presence of various signals before generating an enabling signal P22 to EPROM 62, and hence a complete detailed description is not here set out.

The address bus (A0–A15) is connected to the EPROM 62, while the data lines D0–D7 are connected to the EPROM 62 and the P1A60 to carry out the operations and power input, based on inputs received i.e., the various photodetector and power input conditions, output signals are generated controlling the D.C. motor 54. Additional outputs enable other optional applications to be conveniently added.

The 8 standard FET outputs on the CPU board 42 are inadequate for use in controlling the amount and direction of current used by the motor 54. Thus, the Motor Driver (MD) board 50 takes the logic signals from 4 of the 8 standard outputs on the CPU board 42 and acts, as a primary interface between the CPU board 42 and the D.C. motor 54.

Figure 7:
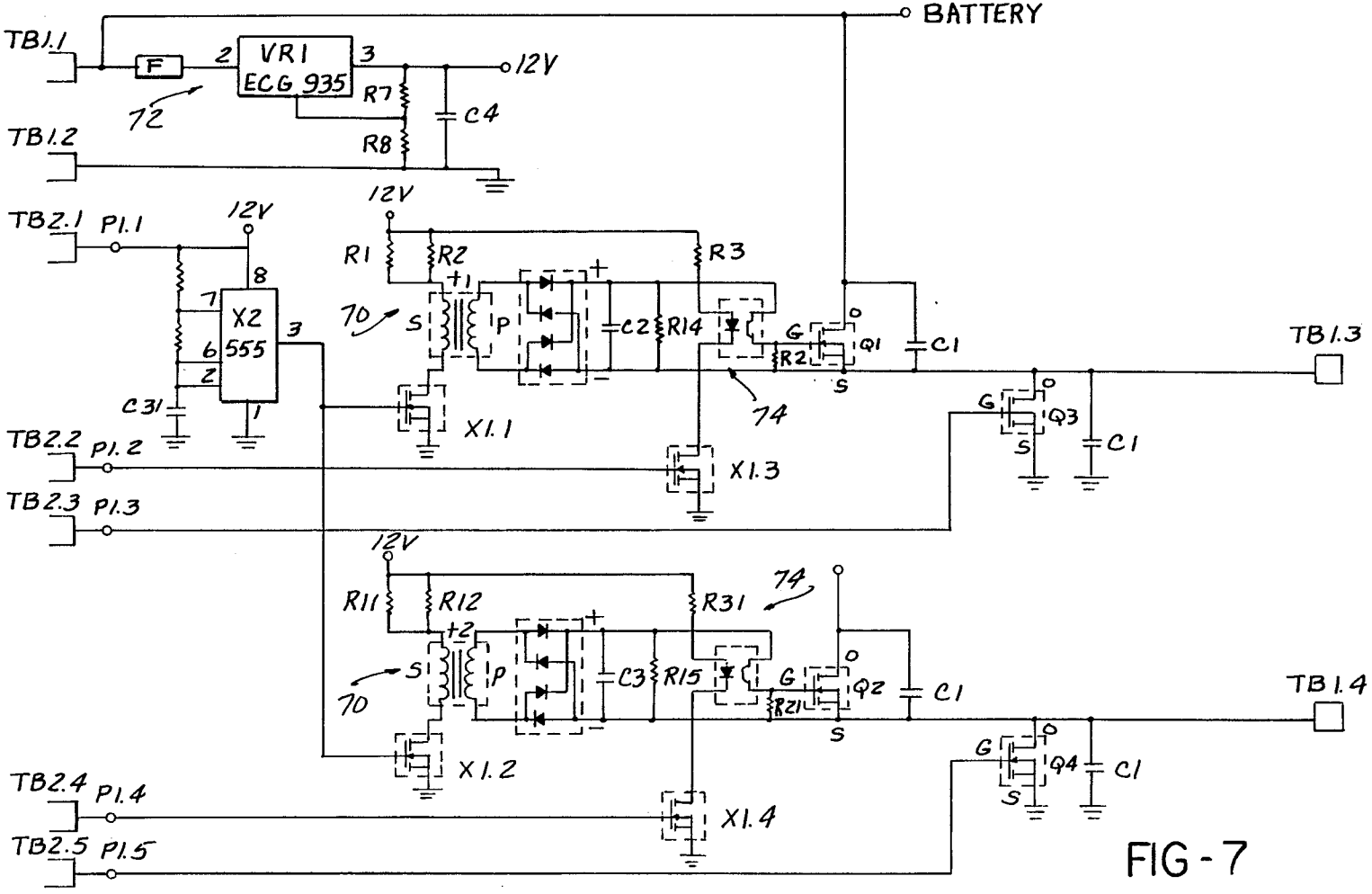
FIG. 7 is a schematic diagram of the motor driver circuit incorporated in the on-board control according to the present invention.

FIG. 7 depicts the circuit contained on the MD board 50, which is made up of 100% solid state components. The MD board (50) is capable of delivering 20 amps of 4 quadrant D.C. motor control. Speed controlled using the Pulse Width Modulation (PWM) technique—the pulse width and modulation frequency are determined by the signals sent via the CPU outputs. The direction of rotation as well as speed is determined by the conducting state of the four primary switching devices Q1,Q2,Q3 and Q4, which directly pass the motor current.

The MD board 50 uses N-channel power Metal Oxide Field Effect Transistors (MOSFETs) as the switching devices Q1,Q2,Q3 and Q4 to switch or control the conduction of the motor current. The power MOSFET is used because it has a very high input impedance and a very low "ON" state resistance. The power MOSFET is a voltage controlled three terminal device. Here, the MOSFETs are used in either the full "OFF" state or the full "ON" state. The Drain-to-Source resistance (Rds) of the power MOSFET is in the mega-ohm region (OFF) when the voltage measure from the Gate-to-Source (Vgs) is at zero volts and Rds (for a variety of devices) is less than 1 ohm (ON) when Vgs is greater than 10 volts DC. The gate current when the device is conducting is on the order of Nano-amps, requiring very little power to activate the device.

MOSFETs Q1 and Q2 switch the positive rail and MOSFETs Q3 and Q4 switch the negative rail. The Source pins of devices Q3 and Q4 are directly tied to ground (or the negative rail). Therefore, the voltage applied to the Gate of those devices will always be referenced to a fixed voltage which in this case is ground reference—regardless of how much current is being conducted by the motor 54. Thus, if zero volts is applied to the Gate Q3, then Q3 will be in the "OFF" state because Vgs is 0 volts; if 12 volts is applied to the Gate then the Q3 will be in the "ON" state.

The positive rail switches Q1 and Q2, require a special circuit to ensure the control voltage, Vgs, to be either at zero volts or 12 volts as required. When the circuit is set to conduct thru device Q1, the Source pin will be at a voltage level somewhere between ground reference and the positive rail of the battery. When the circuit is properly conducting, the voltage level of Q1 Source will begin to approach the positive rail value. However, for the device to conduct properly, the Gate voltage must be 12 volts above the Source. At the same time, the Source pin of device Q2 will drop down towards the negative rail. The Gate voltage of Q2 must remain at the same level as the Q2 Source as the Source voltage drops to prevent Q2 from conducting. The gate control voltage, Vgs, for both Q1 and Q2 must ride ontop or "float" above the source voltage regardless of the source voltage with respect to the battery rails.

The Vgs control requires little power, and audio transformers 70 are used to generate an alternate voltage source which is "electrically" independent from the battery, and can provide enough bias power to the MOSFETs with a minimum number of components.

The timer/oscillator (X2) circuit 74 generates a 1 Kilo-Hertz 12 Vp-p square wave signal from a 12 V signal received from voltage regulator circuit 72. This signal is applied to the gates of small MOSFETs X1.1 and X1.2, which in turn switches current on and off thru the secondary side of the audio transformers to T1 and T2. The primary output voltage of the transformer, which is isolated from the battery, is rectified by BR1 (BR2) and filtered using C1 (C3) and R1 (R15). The resulting voltage measured across the filter capacitor C2 is roughly 12 volts D.C.

The negative leg of the floating voltage source has been tied to the source pin of the corresponding positive rail switching MOSFET Q1, Q2. This connection will cause the floating voltage source to always ride above the source voltage. The output of an optical-isolator transistor 74 is connected to the gate of the corresponding positive rail switching MOSFET Q1, Q2. If the optical-isolator transistor 74 is in the conduction region, the gate voltage of the switching MOSFET will maintain roughly a 12 volt differential above the source and the switching MOSFET will always conduct, regardless of the voltage measured between the source and the battery rails. If the optical-isolator transistor 74 is not in the conducting region, the gate voltage of the switching MOSFET Q1, Q2 will be pulled down (through the pull-down resistors R2 and R21) to the same potential as the source. This will force the switching MOSFET to be in the non-conducting state. Again, regardless of the voltage measured between the source and the battery rails.

The conducting state of the positive rails switching MOSFETs Q1, Q3 is dependent on the conducting state of the optical-isolator transistor. The optical-isolator 74 will conduct if there is nominally 15 milli-amps of current passing through an internal I.R. diode. This is accomplished by raising the gate voltage of FET switches X1.3 and X1.4. Like the control of the power MOSFETs, the FET switches will pass current when properly biased and for this design. The amount of current will be limited by the parallel resistors R1–R2 and R11–R12. The gates of the switches X1.3 and X1.4 are tied to pins which will be connected to the corresponding pins on the CPU board. This is also true for the gate connections to switches Q3 and Q4. These connections allow the direct control of the conducting state of the four primary switches, Q1, Q2, Q3, and Q4 by the CPU.

As discussed above a "ramping" control, is built into the program in maintaining a preset speed. In this approach the power applied to the motor is monitored and compared to a preset level of power, referred to as the "ultimate" power desired in any condition.

Figure 8:
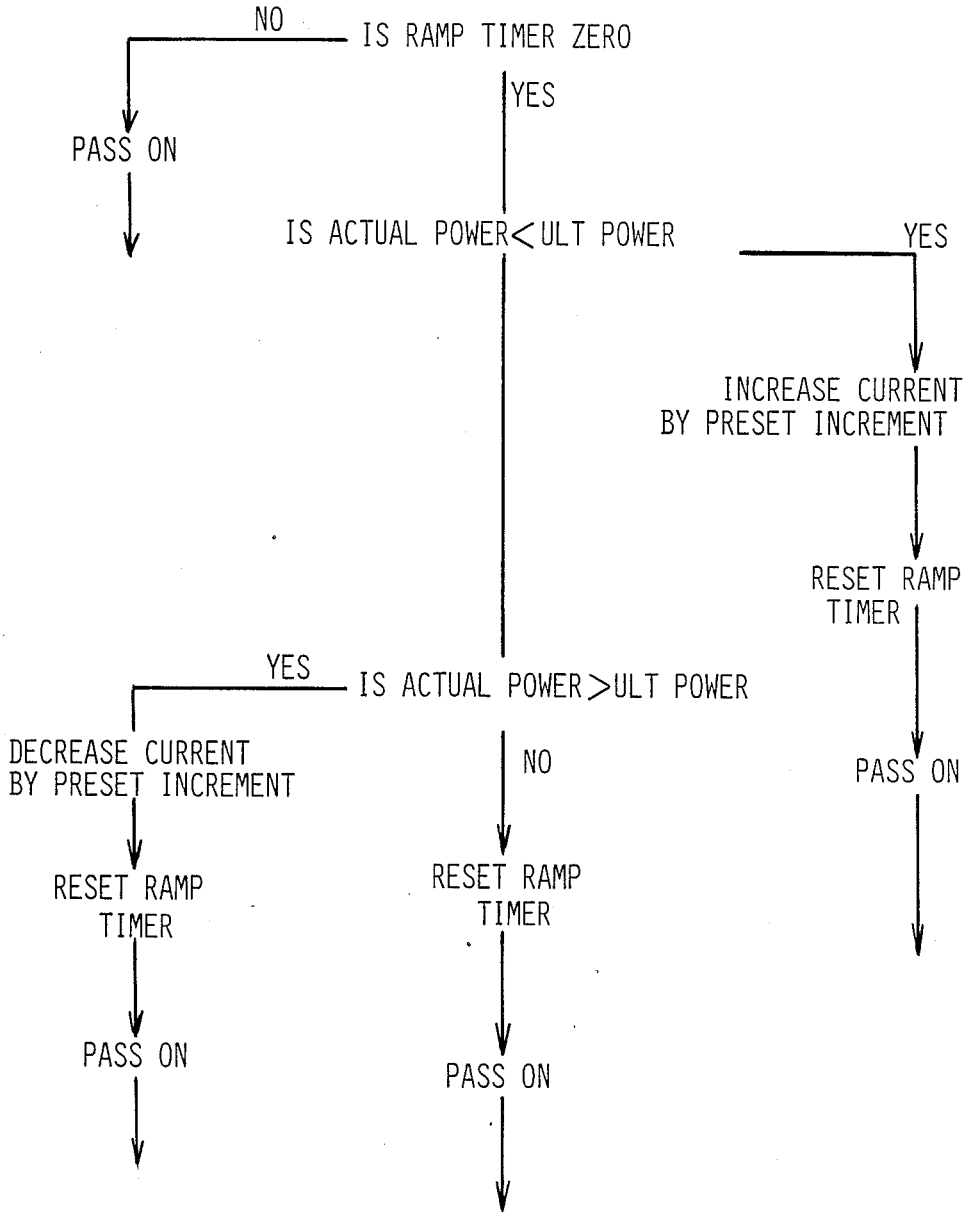
FIG. 8 is a flow diagram for the ramping logic utilized in the on-board control.

FIG. 8 is a flow diagram depicting the process, in which an incremental change (i.e. 10%) in current is occasioned (by the pulse width modulation technique) to force the power to an "ultimate" programmed level. Thus, the acceleration and deceleration is gradual in starting and stopping or changing speeds of each vehicle.

This ramping is quite significant in the context of queueing control, as the diffuse photosensors 32, 34 are triggered at some substantial distance on the order of several inches to a foot as one vehicle 12 approaches another, allowing sufficient distance to carry out the gradual deceleration of the vehicle.

Figure 9:
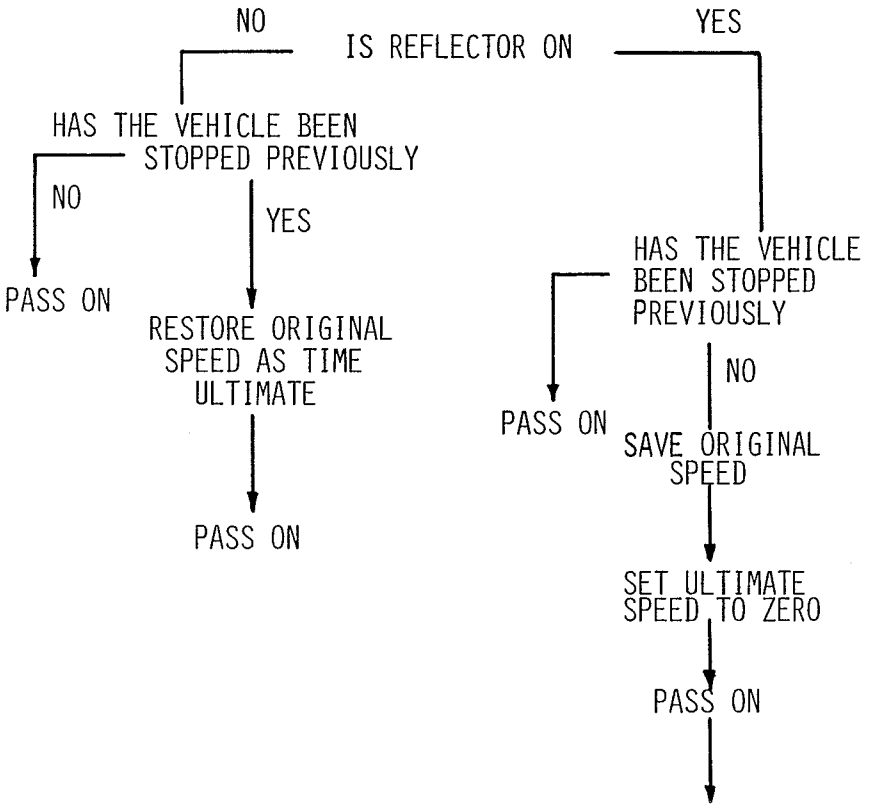
FIG. 9 is a flow diagram of the photodetector condition logic used for queing of the vehicles.

FIG. 9 is a flow diagram illustrating the logic associated with the diffuse reflective photosensors, which is combined with the ramping logic by setting the ultimate speed to zero, after a photosensor is triggered.

Figure 10:
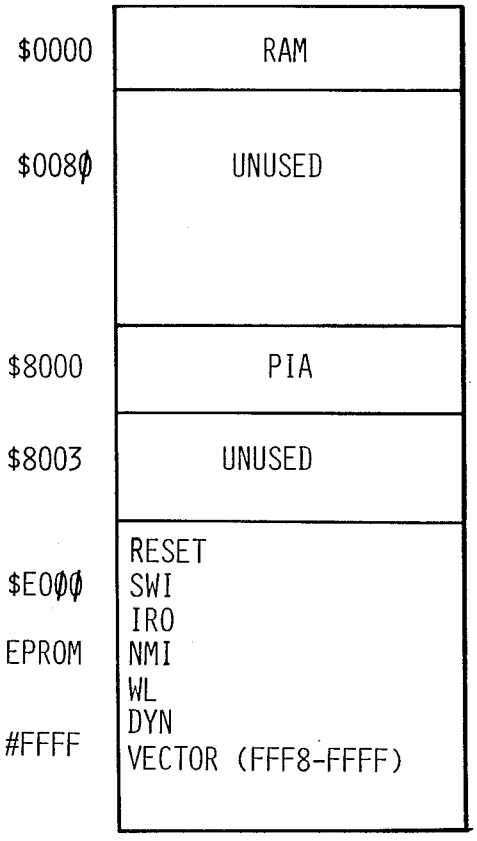
FIG. 10 is a memory map used in the program of the control board according to the present invention.

FIG. 10 illustrates the memory map for the CPU processor board, and the following is a program listing for a typical application:

```
        NAM    RESET START
*********************************************************  *
*       THIS IS THE STA... OF TEST ROUTINE                 *
*       THIS ROUTINE IS FOR THE MGV PROJECT                *
*       7/28/87                                            *
*****************************************************************
*          ADDRESS MAPPING                                 *
*       $0000 - $0080   INTERNAL RAM                       *
*       $0081 - $3FFF   UNUSED                             *
*       $8000 - $8003   PIA                                *
*       $E000 - $FFFF   EPROM PROGRAM SPACE                *
*       $FFF8 - $FFF9   IRQ, INTERUPT REQUEST              *
*       $FFFA - $FFFB   SWI, SOFTWARE INTERUPT             *
```

5291
9-11

```
*        $FFFC - $FFFD   NMI, NON-MASKABLE INTERUPT     *
*        $FFFE - $FFFF   RESET POWER UP VECTOR          *
*****************************************************
*
        XDEF    RESET,PORTA,PORTB,CONTA,CONTB
        XDEF    IPORTA,IPORTB,ICONTA,ICONTB
        XDEF    RUNST,DIRSTE                    LOW MEMORY REQRMT'S
        XDEF    INT_C,INTOFF,INTON
*
        XREF    MAIN
        XREF    RAMCHK,RMGOOD
        XREF    TRFL
        XREF    TIME0,TIME1,TIME2,RTIME,DTIME
        XREF    TRAMP,MPC,PPC
        XREF    PLSBSE,DIRBYT,DYNBYT
        XREF    STOP,FOWRD,REVRS,SPEED
        XREF    FOWON,REVON,FOWBT1,REVBT1
        XREF    FULSPD,SLWSPD,ZERSPD
*
        .PAGE0
*
IPORTA  RMB     1
IPORTB  RMB     1
ICONTA  RMB     1
ICONTB  RMB     1
RUNST   RMB     1
DIRSTE  RMB     1
*
        .CODE
*
PORTA   EQU     $8000
CONTA   EQU     $8001
PORTB   EQU     $8002
CONTB   EQU     $8003
INT_C1  EQU     %00000001       ACTIVATES CHANNEL ONE INTERUPT
INT_C2  EQU     %00001000       ACTIVATES CHANNEL TWO INTERUPT
INT_C   EQU     INT_C1+INT_C2   ACTIVATES BOTH INTERUPTS ON BOTH CHANNELS
INTOFF  EQU     %00000100       TURNS OFF INTERUPT, MAINTAINS I/O REGISTER
INTON   EQU     %00000100       TURNS ON INTERUPT, MAINTAINS I/O REGISTER
DDR     EQU     $00             ACCESS DATA DIRECTION REGISTER
IOR     EQU     %00000100       ACCESS I/O REGISTER
*
************************
                        SET                                HIGHEST
RESET   EQU     *
STACK   EQU     *       THE STACK ADDRESS TO THE   HEST LOCATION IN RAM
        LDS     #$7F    REMEMBER $80 = $00 THRU $7F
*                       THE STACK IS NOW SET UP.
        SEI
        LDAA    #RMGOOD
        STAA    RAMCHK
*
PIA     EQU     *       SET UP THE PIA DATA DIRECTION AND INTERUPT REGISTERS
*                       CA1, CA2, CB1 AND CB2 ARE ALL INTERUPT INPUTS.  PORT A
*                       ARE ALL INPUTS AND PORT B ARE ALL OUTPUTS.
        CLR     CONTA
        CLR     CONTB
        CLR     PORTA   ALL ZERO'S IN DATA DIRECTION REGISTER IS INPUTS
        LDAA    #$FF
        STAA    PORTB   PUTTING ALL ONE'S IN DDR-B WILL PROGRAM PORT B TO BE
*                       ALL OUTPUTS.
        LDAA    #INTON  SET UP THE INTERUPT STATUS AND I/O REGISTER
        STAA    CONTA
        STAA    CONTB
DRIVER  EQU     *
        CLR     PORTB           TURN OFF ALL THE OUTPUTS
STAT0   EQU     *
        LDAA    DIRSTE
        CMPA    #FOWON
        BEQ     STAT1
        CMPA    #REVON
        BEQ     STAT2
```

```
        JSR     FOWRD
        JMP     STAT3
STAT1   EQU     *
        LDAA    #FOWBT1
        STAA    DIRBYT
        JMP     STAT3
STAT2   EQU     *
        LDAA    #REVBT1
        STAA    DIRBYT
        JMP     STAT3
STAT3   EQU     *
        LDAA    RUNST
        CMPA    #FULSPD
        BEQ     STAT4
        CMPA    #SLWSPD
        BEQ     STAT4
        CMPA    #ZERSPD
        BEQ     STAT4
        JSR     STOP
        CLR     DYNBYT
        CLR     RUNST
        JMP     STAT5
STAT4   EQU     *
        JSR     SPEED
STAT5   EQU     *
TIMERS  EQU     *                   CLEAR ALL THE TIMERS TO ZERO.
        LDX     #$0000
        STX     TIME0
        STX     TIME1
        STX     ~~TIME2~~ TIME2
        STX     ~~TRAI~~ TRAMP
*        STX     ~~RTIME~~ RTIME
*        STX     DTIME
DYNO    EQU     *
        LDX     #FULSPD
        DEX
        STX     PLSBSE
        STX     MPC
*        CLR     DIRBYT
*        CLR     DIRSTE
        CLR     PPC
*
        JMP     MAIN
        END

        NAM     SOFT
*********************   *************************   *************************
*
*       THIS IS THE SWI SERVICE ROUTINE.  FOR NOW IT WILL JUST RETURN FROM
*       THE INTERUPT.
*
*******************************************************************************
*
        .CODE
*
        XDEF    SOFT
*
SOFT    EQU     *
        RTI
*
        END

        NAM     IREQ
*************************   *************************   *********************
*
*       THIS IS THE *IRQ SERVICE ROUTINE.  IT'S PRIMARY PURPOSE IS TO CAPTURE
*       THOSE INPUTS WHICH ARE FAST AND CRITICAL TO THE CONTROL OF THE SYSTEM.
*
*******************************************************************************
*
```

```
        XDEF    IREQ
*
        XREF    PORTA,PORTB
*
        .CODE
*
IREQ    EQU     *
        LDAA    PORTA   RESET INTERRUPT ON PORT A IF NECCESSARY
        LDAA    PORTB   RESET INTERRUPT ON PORT B IF NECCESSARY
        RTI
        END


        NAM     CLOCKS
************************   ************************   ***********************
*
*       THIS IS THE TIMER INTERUPT ROUTINE USED TO PROCESS THE *NMI SIGNAL.
*       CURRENTLY IT WILL ONLY TRACK FOUR DOWN COUNT TIMERS.
*
*******************************************************************************
*
        XDEF    CLOCKS
        XDEF    RAMCHK,RMGOOD
        XDEF    PIOD,MPC,PPC,TRAMP
        XDEF    TIME0,TIME1,TIME2,RTIME,DTIME
*
        XREF    RESET,PORTB,PORTA,IPORTA,IPORTB
        XREF    DIRSTE,DIRBYT
        XREF    TREF,PULREF,PLSBSE
        XREF    RUNCAR,DEVSTP,EMSTOP,TAPE
        XREF    FAIL1,FAIL2
*
        .PAGE0
*
TIME0   RMB     2
TIME1   RMB     2
TIME2   RMB     2
RTIME   RMB     2
DTIME   RMB     2
RAMCHK  RMB     1
RMGOOD  EQU     $7
TRAMP   RMB     2
PIOD    RMB     1
MPC     RMB     2
PPC     RMB     1
SAFE    RMB     1
*
        .CODE
*
CLOCKS  EQU     *
        LDAA    RAMCHK
        CMPA    #RMGOOD
        BEQ     CLOCKA
        JMP     RESET
CLOCKA  EQU     *
        LDX     TIME0
        BEQ     CLOCK1
        DEX
        STX     TIME0
CLOCK1  EQU     *
        LDX     TIME1
        BEQ     CLOCK2
        DEX
        STX     TIME1
CLOCK2  EQU     *
        LDX     TIME2
        BEQ     CLOCKR
        DEX
        STX     TIME2
```

```
CLOCKR  EQU     *
        LDX     RTIME
        BEQ     CLOCKD
        DEX
        STX     RTIME
CLOCKD  EQU     *
        LDX     DTIME
        BEQ     CLOCKZ
        DEX
        STX     DTIME
CLOCKZ  EQU     *
        LDAA    PORTA
        STAA    IPORTA
        ANDA    #DEVSTP
        CMPA    #RUNCAR
        BEQ     SAFE1
        CLR     PPC
        LDX     #$07A1          TWO SECOND DELAY
        STX     MPC
SAFE1   EQU     *               TURN OFF CRITICAL OUTPUTS WHEN TAPE IS HIT
        LDAA    IPORTA
        BITA    #TAPE
        BNE     SAFE2
        LDAA    #EMSTOP
        COMA
        STAA    SAFE
        JMP     PULSES
SAFE2   EQU     *
        LDAA    #$FF
        STAA    SAFE
PULSES  EQU     *
*                               START OF ACCEL/DECEL CODE
        LDX     TRAMP
        BNE     RAMP01          IF TRAMP IS NON-ZERO THEN PASS OVER THIS
        LDX     #TREF
        STX     TRAMP           RESTORE THE RAMP TIMER
        LDAA    PIOD
        CMPA    PULREF          RESULTS = PIOD - PULREF
        BEQ     RAMP02          IF THEY ARE EQUAL THEN DO NOTHING
        BGT     RAMP03          DECREASE PIOD IF GREATER THAN PULREF
        INC     PIOD            THIS WILL INCREASE PIOD
        JMP     RAMP02
RAMP03  EQU     *
        DEC     PIOD
        BGE     RAMP02
        CLR     PIOD            IF PIOD HAS GONE NEGATIVE THEN CLEAR IT
        JMP     RAMP02
RAMP01  EQU     *
        DEX
        STX     TRAMP
RAMP02  EQU     *               END OF ACCEL/DECEL CODE
        LDX     MPC
        BEQ     SETMPC
        DEX
        STX     MPC
        TST     PPC
        BEQ     PLSOFF
PULSON  EQU     *
        DEC     PPC
        LDAA    DIRSTE
        ANDA    #$0F            USE JUST THE MOTOR DRIVER DATA AT THIS POINT
        LDAB    IPORTB
        ANDB    #$F0
        ABA                     COMBINE THE RESULTS
        ANDA    SAFE
        STAA    PORTB           PLACE THE RESULTS BACK IN PORTB
        JMP     PLSEND
PLSOFF  EQU     *
        LDAA    DIRSTE
        EORA    DIRBYT          HOLD THE DIRECTION STATE
        ANDA    #$0F            USE JUST THE MOTOR DRIVER DATA AT THIS POINT
```

```
        LDAB    IPORTB
        ANDB    #$FO
        ABA                     COMBINE THE RESULTS
        ANDA    SAFE
        STAA    PORTB           PLACE THE RESULTS BACK IN PORTB
        JMP     PLSEND
SETMPC  EQU     *
        LDX     PLSBSE          PULSE BASE MODULATION
        STX     MPC
        LDAA    PIOD
        STAA    PPC
PLSEND  EQU     *
        LDAA    PORTB           THIS SECTION WILL CHECK THE OUTPUTS
        ANDA    #FAIL1
        CMPA    #FAIL1
        BNE     RETRN
        LDAA    PORTB
        ANDA    #FAIL2
        CMPA    #FAIL2
        BNE     RETRN
        CLR     PORTB
        JMP     RESET
RETRN   EQU     *
        RTI
*
        END


        NAM     MAIN
*
        XDEF    MAIN
        XDEF    DEVSTP,RUNCAR,EMSTOP,TAPE
        XDEF    TRFL
*
        XREF    PORTA,PORTB,IPORTA,IPORTB
        XREF    FOWRD,REVRS,SPEED,STOP,CHGDIR
        XREF    ZERSPD,SLWSPD,FULSPD
        XREF    TIMEO,DTIME,RTIME
        XREF    RUNST
*
        .PAGEO
*
I2LAST  RMB     1
CURRST  RMB     1
TRFL    RMB     1
PHOTST  RMB     1
TMPLST  RMB     1
LASTST  RMB     1
LEVEL   RMB     2
         =        =        =        =        =
TIMVAL  EQU     15              15 MILI-SECOND DELAY
*
TAPE    EQU     %10000000       TAPE SWITCH INPUT BIT
CLAMP   EQU     %01000000       CLAMP CLOSED PROX INPUT BIT
BOLT    EQU     %00100000       BOLT/UPPER RACK PROX INPUT BIT
RACK    EQU     %00010000       CARRAIGE/RACK LOWER PROX INPUT BIT
RACKON  EQU     %00110000       TEST TO SEE IF THE RACK IS ON
SPDPE   EQU     %00001000       SPEED PHOTO INPUT BIT
DIRPE   EQU     %00000100       DIRECTION PHOTO INPUT BIT
AUXFOW  EQU     %01000000       FOWARD DIRECTION AUXILLIARY MOTOR
AUXREV  EQU     %11000000       REVERSE DIRECTION AUXILLIARY MOTOR
DEVSTP  EQU     %11000000       THESE INPUTS MUST BE USED TO STOP THE CAR
RUNCAR  EQU     %11000000       THIS IS THE VALUE OF DEVSTP INPUT TO RUN CAR
LOADPE  EQU     %00100000       LOAD PHOTO EMITTER OUTPUT
EMSTOP  EQU     %11000000       THESE OUTPUTS WILL TURN OFF WHEN TAPE IS HIT
*
        .CODE
****************************
*   BEGIN ROUTINE          *
****************************
```

```
MAIN     EQU     *
         LDAA    PORTA
         ANDA    #RACKON
         CMPA    #RACKON
         BEQ     MAIN2
         LDAA    #LOADPE
         JMP     MAIN3
          =       =       =       =       =
MAIN2    EQU     *                TURN OFF THE PHOTO EMITTER
         CLRA
MAIN3    EQU     *
         STAA    IPORTB
         LDX     #LEVELO
         STX     LEVEL
          =       =       =       =       SECOND
         LDX     ~~#03~~ #103F    ROUGHLY A 1 ~~SECOND~~ DELAY
         STX     TIMEO
MAIN4    EQU     *                THIS TIME DELAY LOOP IS USED TO
         LDX     TIMEO            LET THE PHOTO-EYE INPUTS STABILIZE
         BNE     MAIN4            AND PREVENT THE POWER-ON CONDITION
         LDAA    IPORTA           TO CHANGE THE STATUS OF THE SPEED INPUT.
         ANDA    #SPDPE           THIS LOGIC WILL ONLY FAIL IF THERE WAS
         STAA    CURRST           A PHOTO-EYE TRANSITION AT THE TIME OF
         STAA    PHOTST           POWER-UP.
         STAA    LASTST
         CLR     TRFL
MAIN1    EQU     *
         JSR     ADDR1            CHECK THE SPEED PHOTO INPUT
         JSR     ADDR3            CHECK THE DIRECTION PHOTO INPUT
         JSR     ADDR4            LOAD TRANSFER LOGIC
         JMP     MAIN1
*
*************************************************
*        PHOTOEYE STATE                         *
*************************************************
ADDR1    EQU     *
*
*
          =       =       =       =       =
         JSR     ADDR2            GET PHOTOEYE STATUS
         LDAA    PHOTST           CURRENT PHOTOEYE STATE OFTER DEBOUN
         CMPA    LASTST           COMPARE TO LAST STATE
         BEQ     SAME             ROUTINE IF NO CHANGE
         TSTA                     RESET A'S FLAGS
         BNE     TON
*
TOFF     EQU     *
         JMP     OUT
*
TON      EQU     *
         LDAA    RUNST
         CMPA    #SLWSPD
         BEQ     DIDLE
         CMPA    #ZERSPD
         BEQ     DSTART
DDECEL   EQU     *
         LDAA    #SLWSPD
         STAA    RUNST
         JSR     SPEED
         JMP     OUT
*
DIDLE    EQU     *
         JSR     STOP
         CLR     RUNST
         JMP     OUT
*
DSTART   EQU     *
         LDAA    #FULSPD
         STAA    RUNST
```

```
                SPEED
        JSR     ~~SPF~~
        JMP     ~~BU~~    OUT
*
        JMP     OUT
*
SAME    EQU     *
         =        =        =        =        =
        TSTA                     RESET A'S FLAGS
        BNE     SON
*
SOFF    EQU     *
        JMP     OUT
*
SON     EQU     *
        JMP     OUT
*
OUT     LDAA    PHOTST
        STAA    LASTST
        RTS
*
****************************
*        DEBOUNCE LOGIC     *
****************************
*
         =        =        =        =        =
ADDR2   EQU     *
        LDAA    IPORTA
        ANDA    #SPDPE           SPEED PHOTO INPUT BIT
        STAA    CURRST
DEB1    LDX     DTIME            IF TIMER =0
        BNE     DEB3
        LDAA    TRFL             CHECK        TRANSFER FLAG
        BEQ     DEB2
        LDAA    CURRST           SET LAST STATE TO CURRENT STATE
        STAA    PHOTST
        CLR     TRFL             CLEAR TRANS FLAG
        JMP     EXIT
*
DEB2    LDAA    CURRST           COMPARE CURRENT STATE TO LAST STATE
        CMPA    PHOTST
        BEQ     EXIT             IF EQUAL THEN DO NOTHING
*
        STAA    TMPLST           SET CURRENT STATE TO TEMPLAST
        LDX     #TIMVAL          RESET TIMER
        STX     DTIME
        LDAA    #$FF             SET TRANSITION FLAG
        STAA    TRFL
        JMP     EXIT
*
DEB3    LDA     CURRST           COMPARE CURRENT TO TEMPLAST
        CMPA    TMPLST
        BEQ     EXIT             IF EQUAL DO NOTHING
*
        STAA    TMPLST           SET TEMPLAST = TO CURRENT STATE
        LDX     #TIMVAL          RESET TIMER
        STX     DTIME
*
EXIT    RTS
*
*****************
*       CHANGE DIRECTION LOGIC
*****************
*
ADDR3   EQU     *
        LDX     RTIME
        BNE     ADDR30
        LDAA    IPORTA
        BITA    #DIRPE           DIRECTION PHOTO INPUT BIT
        BEQ     ADDR30
        JSR     CHGDIR
```

```
        LDX     #1953           TWO SECOND DELAY
        STX     RTIME
ADDR30  EQU     *
        RTS
****************
*       AUXILLIARY MOTOR AND LOAD PHOTO EMITTER LOGIC
****************
*
ADDR4   EQU     *
        LDX     LEVEL
        CPX     #LEVEL4
        BEQ     LEVELZ          IT WOULD BE MORE EFFICIENT TO JUMP
        CPX     #LEVEL3         TO AN ADDRESS USING THE X REGISTER DIRECTL
        BEQ     LEVELZ          BUT THIS METHOD IS SAFER BECAUSE THE
        CPX     #LEVEL2         PROGRAM WILL NOT JUMP TO A POSSIBLE
        BEQ     LEVELZ          RANDOM ADDRESS CONTAINED IN LEVEL.
        CPX     #LEVEL1
        BEQ     LEVELZ
        CPX     #LEVEL0
        BEQ     LEVELZ
        JMP     LEVEL0
LEVELZ  EQU     *
        JMP     0,X
LEVEL0  EQU     *               JUST WAITING FOR THE CLAMP TO CLOSE
        LDAA    IPORTA
        BITA    #CLAMP
        BEQ     LV01
        RTS
LV01    EQU     *               LOOK AT THE RACK PROX SWITCHES
        ANDA    #RACKON         MASK OFF THE UNWANTED BITS
        CMPA    #RACKON         TEST WHETHER THE RACK IS ON
        BNE     EJECT
RECEIV  EQU     *
        LDX     #LEVEL2
        STX     LEVEL
        LDAA    #AUXFOW
        ORAA    IPORTB
        STAA    IPORTB
        RTS
EJECT   EQU     *
        LDX     #LEVEL1
        STX     LEVEL
        LDAA    ~~#AUXF~~  #AUXREV
        ORAA    ~~IPOR1~~  IPORTB
        STAA    IPORTB
        RTS
LEVEL1  EQU     *               EJECTING THE RACK
        LDAA    IPORTA
        ANDA    #RACKON         MASK OFF THE UNWANTED BITS
        CMPA    #RACKON         THE 'A REGISTER MUST EQUAL RACKON
        BEQ     LV10            BEFORE IT CAN BE ASSUMED THAT THE
        RTS                     RACK HAS BEEN COMPLETELY EJECTED.
LV10    EQU     *
        LDAA    #LOADPE         TURN OFF THE LOAD PRESENT EMITTER
        COMA
        ANDA    IPORTB
        STAA    IPORTB
        LDX     #LEVEL4
        STX     LEVEL
        RTS
LEVEL2  EQU     *               RECEIVING THE RACK
        LDAA    IPORTA
        COMA
        ANDA    #RACKON
        CMPA    #RACKON
        BEQ     LV20
        RTS
LV20    EQU     *
        LDAA    #AUXFOW         TURN OFF THE MOTOR
        COMA
        ANDA    IPORTB
```

```
        ORAA    #LOADPE         TURN ON THE LOAD PRESENT EMITTER
        STAA    IPORTB
        LDX     #LEVEL3
        STX     LEVEL
        RTS
LEVEL3  EQU     *               WAIT FOR CLAMP TO OPEN UP
        LDAA    IPORTA
        BITA    #CLAMP
        BNE     LV30
        RTS
LV30    EQU     *
        LDX     #LEVELO
        STX     LEVEL
        RTS
LEVEL4  EQU     *               WAIT FOR THE CLAMP TO OPEN
        LDAA    IPORTA          AND THEN TURN OFF THE MOTOR.
        BITA    #CLAMP
        BNE     LV40
        RTS
LV40    EQU     *
        LDAA    #AUXREV
        COMA
        ANDA    IPORTB
        STAA    IPORTB
        LDX     #LEVELO
        STX     LEVEL
        RTS
*
        END

                DYNAMICS
        NAM     ~~DYNA~~ S
*
        XDEF    DYNAMIC
        XDEF    FOWRD,REVRS,STOP,BREAK,START,SPEED,CHGDIR
        XDEF    PLSBSE,DIRBYT,DYNBYT,PULREF,TREF
        XDEF    FULSPD,SLWSPD,ZERSPD
        XDEF    FOWBT1,REVBT1,FOWON,REVON
        XDEF    FOWBT2,FOWOFF,REVBT2,REVOFF
        XDEF    POSRLS,NEGRLS
        XDEF    FAIL1,FAIL2
*
        XREF    PORTB,PORTA
        XREF    CONTA,CONTB,ICONTA,ICONTB,IPORTA,IPORTB,INT_C
        XREF    INTOFF,INTON,PPC,MPC,PIOD
        XREF    DIRSTE
*
        .PAGEO
*
FOWOFF  EQU     %11110110       TURNS OFF THE FOWARD BITS
REVOFF  EQU     %11111001       TURNS OFF THE REVERSE BITS
FOWON   EQU     %00001001       TURNS ON THE FOWARD BITS
REVON   EQU     %00000110       TURNS ON THE REVERSE BITS
FOWBT2  EQU     %00000001       FOWARD NEGATIVE RAIL
FOWBT1  EQU     %00001000       FOWARD POSITIVE RAIL
REVBT2  EQU     %00000100       REVERSE NEGATIVE RAIL
REVBT1  EQU     %00000010       REVERSE POSITIVE RAIL
NEGRLS  EQU     %00001010       NEGATIVE RAILS
POSRLS  EQU     %00000101       POSITIVE RAILS
FAIL1   EQU     %00001100       FOWARD POSATIVE AND REVERSE NEGATIVE
FAIL2   EQU     %00000011       FOWARD NEGATIVE AND REVERSE POSITIVE
*
SPD62   EQU     62
SPD61   EQU     61
SPD46   EQU     46
SPD45   EQU     45
SPD33   EQU     33
SPD32   EQU     32
SPD31   EQU     31
SPD15   EQU     15              FULL SPEED
SPD10   EQU     10
```

```
SPD05   EQU     05
SPD04   EQU     04
SPD01   EQU     01
FULSPD  EQU     SPD15
SLWSPD  EQU     SPD10
ZERSPD  EQU     00
*
PULREF  RMB     1
PLSBSE  RMB     2
DIRBYT  RMB     1
DYNBYT  RMB     1
TREF    EQU     FULSPD/2
*
        .CODE
*****************************
*       BEGIN ROUTINES      *
*******************  ********
*
DYNAMIC EQU     *
*
FOWRD   EQU     *
        PSHA
        LDAA    DIRSTE
        CMPA    #FOWON
        BNE     FOWRD1
        PULA
        RTS
FOWRD1  EQU     *
        PSHB
        JSR     STOP
        LDAA    #$F0
        ORAA    IPORTB
     STAA     PORTB
        LDAA    #FOWBT1
        STAA    DIRBYT
        LDAA    #FOWON
        STAA    DIRSTE
        LDAB    IPORTB
        ANDB    #$F0
        ABA
     STAA  PORTB                STORE THE RESULTS IN PORT B
        LDAA    DYNBYT
        JSR     START
        PULB
        PULA
        RTS
*
REVRS   EQU     *
        PSHA
        LDAA    DIRSTE
        CMPA    #REVON
        BNE     REVRS1
        PULA
        RTS
REVRS1  EQU     *
        PSHB
        JSR     STOP
        LDAA    #$F0
        ORAA    IPORTB
     STAA  PORTB
        LDAA    #REVBT1
        STAA    DIRBYT
        LDAA    #REVON
        STAA    DIRSTE
        LDAB    IPORTB
        ANDB    #$F0
        ABA
     STAA  PORTB                STORE THE RESULTS IN PORT B
        LDAA    DYNBYT
        JSR     START
        PULB
        PULA
```

```
        RTS
*
CHGDIR  EQU     *
        PSHA
        LDAA    DIRSTE
        CMPA    #FOWON
        BEQ     GOREV
GOFOW   EQU     *
        JSR     FOWRD
        JMP     CHGDR1
GOREV   EQU     *
        JSR     REVRS
CHGDR1  EQU     *
        PULA
        RTS
*
BREAK   EQU     *
STOP    EQU     *
        CLR     PULREF          MUST BE IN THIS ORDER
        CLR     PIOD            MUST BE IN THIS ORDER
        CLR     PPC
        RTS
*
START   EQU     *
*****  THE 'A' REGISTER HOLDS THE SPEED ******

        LDX     #$BFD           ROUGHLY 3 SECOND DELAY
        STX     MPC
        CLR     PPC
        STAA    PULREF          SET UP THE SPEED DATA
        STAA    DYNBYT          UPDATE THE DYNAMIC STATE VARIABLE
        RTS
*
SPEED   EQU     *
*****  THE 'A'- REGISTER HOLDS THE SPEED ******
        STAA    PULREF
        STAA    DYNBYT          UPDATE THE DYNAMIC STATE VARIABLE
        RTS
*
        END


                VECTOR
        NAM     VEC
*****************************************************************************
*
*       THIS IS THE VECTOR TABLE CONTAINING THE RESET AND VARIOUS INTERUPT
*       ADDRESSES.
*
*****************************************************************************
*
        XREF    CLOCKS,IREQ,RESET,SOFT
*
        .CODE
*
        XDEF    VECTOR
*
VECTOR  EQU     *
        FDB     IREQ
        FDB     SOFT
        FDB     CLOCKS
        FDB     RESET
        END
```

We claim:

1. A conveyor (10) of the type including a plurality of vehicles (12) propelled around a track (14), each of said vehicles (12) being driven by a D.C. motor (54) and an on-board battery (52), said vehicles (12) having means for sensing the approach to a next ahead vehicle (32, 34) and on-board control means (40) for stopping said vehicle (12) to queue said vehicle (12) therebehind, the improvement comprising; photosensor means (32,34) located at the forward end of each of said vehicles (12), triggered only upon the approach to a next ahead vehicle (12) at a distance on the order of several inches, to generate a signal in response to said approach to said next ahead vehicle and triggering of said photosensor means; and, an on-board control (40) responsive to said signal generated upon triggering of said photosensor means to progressively reduce the power to said D.C. motor (54) to zero and thereby gradually decelerate said vehicle (12) to a stop immediately behind said next ahead vehicle.

2. The conveyor (10) according to claim 1 further including system control means (28) for starting and stopping each of said vehicles (12) and wherein said on board control (40) progressively increases or decreases said power to each of said vehicles (12) to gradually accelerate or decelerate said vehicles (12) when starting, stopping, or changing speeds.

3. The conveyor (10) according to claim 1 wherein said on-board control (10) includes a microprocessor chip (58) and a motor driver circuit (50) controlled by signals from said microprocessor chip (58).

4. The conveyor (10) according to claim 2 wherein each of said vehicles (12) is equipped with a pair of side mounted photosensors (32, 34) and said system control means (28) includes photoemitters (26) positioned to excite each of said side mounted photosensors (36, 38), and wherein said on-board control (40) comprises means for reversing or starting or stopping said vehicle (12).

5. The conveyor (10) according to claim 3 wherein said motor driver circuit (50) comprises four N type MOSFETs (Q1,Q2,Q3,Q4) arranged in an H-bridge having a positive and negative rail, said MOSFETs having gates (G) controlled by signals from said microprocessor chip (58).

6. The conveyor according to claim 5 wherein the signals applied to the gates are isolated from said power source by optical isolator transistors (74).

7. The conveyor according to claim 5 wherein said microprocessor signals are pulse width modulated to vary said power supplied to said D.C. motor (54).

* * * * *